US006789553B2

(12) United States Patent
Harris et al.

(10) Patent No.: US 6,789,553 B2
(45) Date of Patent: Sep. 14, 2004

(54) COATINGS REMOVAL HEAD ASSEMBLY AND METHOD OF USE

(75) Inventors: Christopher Phillip Harris, Clayton, OH (US); Dennis Lynn Mesarvey, Jr., Kettering, OH (US)

(73) Assignee: Hammelmann Corporation, Dayton, OH (US)

( * ) Notice: Subject to any disclaimer, the term of this patent is extended or adjusted under 35 U.S.C. 154(b) by 0 days.

(21) Appl. No.: 09/951,364

(22) Filed: Sep. 13, 2001

(65) Prior Publication Data

US 2003/0047200 A1 Mar. 13, 2003

(51) Int. Cl.[7] ..... B08B 3/02; B05B 1/28

(52) U.S. Cl. ..... 134/176; 134/179; 134/198; 239/104; 239/161; 239/164

(58) Field of Search ..... 134/165, 176, 134/179, 198, 200, 57 R; 239/104, 120, 146, 161, 164, 176, 251

(56) References Cited

U.S. PATENT DOCUMENTS 3,168,247 A 2/1965 Schild ..... 239/137
4,903,364 A * 2/1990 Long ..... 15/50.1
5,004,156 A * 4/1991 Montanier ..... 239/130
5,022,927 A * 6/1991 Seidel ..... 134/34
5,028,044 A * 7/1991 Fischer ..... 271/91
5,265,805 A 11/1993 Artenian ..... 239/135
5,291,697 A * 3/1994 Nelson ..... 451/88
5,398,461 A * 3/1995 Rose ..... 451/92
5,851,139 A 12/1998 Xu ..... 451/102
6,012,645 A * 1/2000 Poppitz ..... 239/104
6,105,204 A * 8/2000 Scharwat ..... 15/322

* cited by examiner

*Primary Examiner*—Frankie L. Stinson
*Assistant Examiner*—Joseph Perrin
(74) *Attorney, Agent, or Firm*—Wood, Herron & Evans, LLP

(57) ABSTRACT

A coatings removal head assembly for mounting on a self-propelled apparatus and for connection to one or more fluid supplies and one or more vacuum containment systems. A spring mounting assembly maintains a constant nozzle stand-off distance from a surface to be cleaned. A positively driven rotary spray bar assembly is employed to control the nozzle pass rate in conjunction with the movement of the self-propelled apparatus. A specifically configured exhaust is provided to enhance collection and containment of waste fluid and removed material.

43 Claims, 7 Drawing Sheets

COATINGS REMOVAL HEAD ASSEMBLY AND METHOD OF USE

BACKGROUND OF THE INVENTION

The present invention relates to a coatings head assembly and method of use. More particularly, the present invention relates to a head assembly for mounting on a specific self-propelled apparatus and is most applicable in removing coatings from large surfaces.

Power washing devices are used to remove coatings and undesirable debris from surfaces as part of routine maintenance and in preparation for application of new coatings. Such power washers are often used to remove coatings such as "non-skid" materials, debris, primers and paints from common substrate materials such as steel, aluminum and concrete. There are numerous well known applications for power washers in manufacture and maintenance of ships, aircraft, automobiles, pipes, buildings, bridges, storage tanks, structures, etc.

In general, power washers are comprised of one or more pumps which supply a fluid, generally water, at high pressure, directed through flow constricting nozzles to the surface to be cleaned. Each nozzle produces a jet of fluid which is guided along the surface to be cleaned. In the prior art, the nozzle is generally mounted to, or part of, a hand held device. In some cases, multiple nozzles are incorporated into manual push "lawn mower" type unit and, in some cases, the nozzles are rotated by the force of the jet stream, or by a positively driven spray bar assembly. The advantage of multiple nozzle devices is that larger surface areas can be cleaned more efficiently than with single nozzle devices.

The weight of larger power washing apparatus and/or the thrust produced by larger rotationally driven, multiple nozzle devices precludes utilization in a hand held device. Unsuccessful attempts have been made to attach a power washer to a self-propelled apparatus; known prior art devices either fail in their ability to effectively and efficiently remove coatings and/or lack sufficient containment capabilities.

The effectiveness of power washing apparatus is dependent upon several well known factors. In order to obtain optimum efficiencies, two factors, in addition to operation pressure, are critical. First, the distance from the nozzle(s) to the surface to be cleaned ("nozzle stand-off distance") must be closely controlled. Secondly, the speed at which the nozzles are moved in relation to the surface to be cleaned ("nozzle pass rate") must be closely controlled. Prior art devices are limited in their ability to control the nozzle stand-off distance and/or the nozzle pass rate. The production rate for known prior art power washers is limited to approximately 200 square feet per hour.

Environmental concerns make containment of waste fluid with entrained removed material critical. Prior art devices are limited by their ability to contain the waste fluid and removed material. Containment is equally desired in regard to being able to immediately apply a new coating to the, preferably dry, cleaned surface. Additionally, if fluid remains on steel surfaces, rust will likely form. These factors mandate near 100 per cent containment of the waste fluid and entrained removed material.

SUMMARY OF THE INVENTION

There is a need in the art for a coatings removal head assembly with higher associated production rates, improved coatings removal quality, enhanced containment and increased automation. In furtherance of these objectives, there is a need for a device which allows the nozzle stand-off distance and nozzle pass rate to be controlled and automatically adjusted. Additionally, there is a need for a device which provides a means by which a vacuum containment system can be utilized to collect both the coatings, which have been removed, as well as, the waste fluid. The coatings removal head assembly in accordance with the present invention provides the solution to these needs.

The coatings removal head assembly in accordance with the present invention employs a main mounting bracket assembly, for attachment to a self-propelled apparatus. The main mounting bracket assembly incorporates a spring mounting assembly interposed between the main mounting bracket assembly and the coatings removal head housing assembly. The main mounting bracket assembly, combined with the spring mounting assembly, facilitates automatic control of the nozzle stand-off distance. A nozzle stand-off distance between 1 inch and 1.25 inches is typical; with surface irregularities anticipated to exceed this nozzle stand-off distance, it is imperative to employ automatic adjustment. The spring mounting assembly provides a durable, effective, automatic adjustment of the nozzle stand-off distance with a minimum number of components. The invention is in no way to be limited to a particular type of spring; any positively loaded spring action device capable of automatic expansion and contraction is within the scope of the present invention.

The coatings removal head assembly of the present invention incorporates a positively driven rotary spray bar assembly which provides improved control over the nozzle pass rate. Rotational rates between 1500–3600 revolutions per minute have been found to be most effective dependant upon the speed of movement of the coatings removal head assembly relative to the surface to be cleaned. However, the invention is in no way limited to any rate of rotation of the rotary spray bar assembly.

It will be obvious to those skilled in the art, that fluid pressure, nozzle characteristics and head assembly cut width (the width covered by one pass of the head assembly) are factors to consider in optimizing the effectiveness of a coatings removal head assembly. It is preferred to operate the coatings removal head assembly in accordance with the present invention with fluid pressure of 40,000 pounds per square inch with a 16 inch cut width. However, the invention is in no way to be limited to any given fluid pressure or cut width.

The coatings removal head assembly of the present invention incorporates an exhaust port, or ports, into the housing assembly designed to attach to a vacuum, whereby the fluid and removed coatings can be collected. The location of the exhaust port(s) in relation to the nozzle(s), as well as the flow capability and characteristics of the exhaust of the coatings removal head assembly of the present invention, provides near 100 percent containment.

There is a further need in the art for a coatings removal head assembly which eliminates the necessity of guiding the head assembly along the surface to be cleaned by means of a hand held or manually-propelled device. There is a further need for a device which allows the spray nozzles to be directed at a surface in any global orientation, whether the surface is vertical, horizontal, overhead or some position there between, while attached to a self-propelled vehicle such as a manlift, powered cart or robot. There is a further need for a device which allows a single operator the ability to simultaneously operate multiple head assemblies.

The main mounting bracket assembly of the coatings removal head assembly in accordance with the present invention facilitates mounting to a self-propelled apparatus. In addition, multiple coatings removal head assemblies in accordance with the present invention may be mounted to one self-propelled apparatus, or multiple self-propelled apparatuses may be employed.

The present invention will be best understood by reference to the following detailed description in light of the accompanying figures and appended claims.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
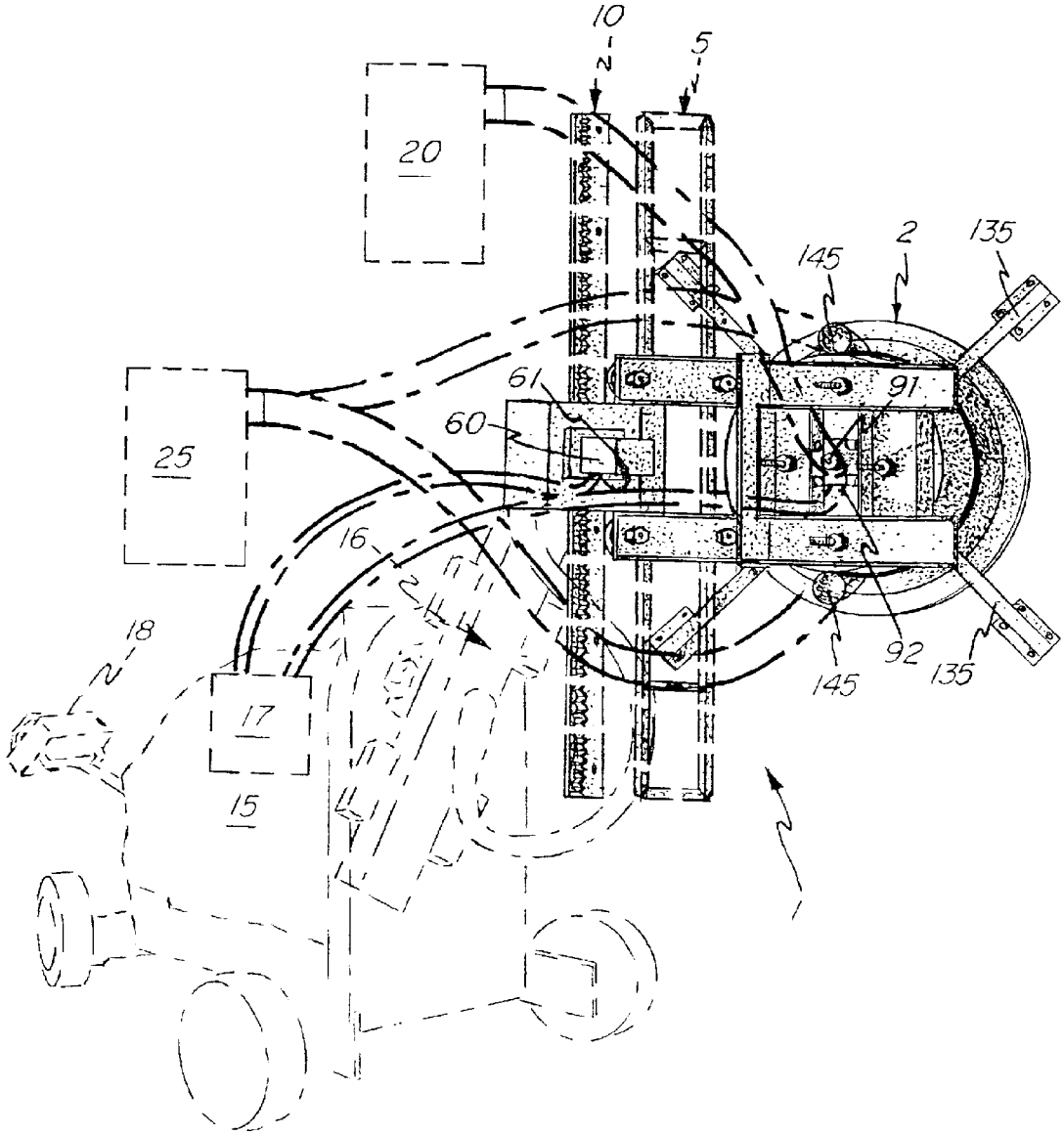
FIG. 1 is a perspective view of a coatings removal head assembly in accordance with the present invention mounted on a self-propelled apparatus and connected to a fluid supply and vacuum containment system.

Referring initially to FIG. 1, there is shown a coatings removal system 1 with coatings removal head assembly 2, in accordance with the present invention, movably attached to the mounting rail 5 of self-propelled apparatus 15. Additionally, as shown in FIG. 1, fluid supply 20 and vacuum containment system 25 are connected to the coatings removal head assembly 2. The preferred self-propelled apparatus 15 is the Conjet, Robot 363, as manufactured by Conjet AB, Haninge, Sweden. The preferred fluid supply system 20 is a high pressure pump, series HDP 230, as manufactured by Hammelmann GmbH, Germany. The preferred vacuum containment system 25 is a Hi-Vac, model 275 as manufactured by Hi-Vac Corporation, Marietta, Ohio. It should be understood that several know self-propelled apparatuses 15, fluid supply systems 20 and vacuum containment systems 25 are known and available. The preferred devices, as specified above, are for exemplary purposes only and are not intended to limit the scope of the present invention in any way.

As shown in FIG. 1, the coatings removal head assembly 2 is oriented in the desired global orientation by positioning arm 16 of self-propelled apparatus 15. In the preferred embodiment, the coatings removal head assembly 2 can be positioned in any global orientation. The articulation of positioning arm 16 provides the ability to clean decks, floors, walls and overhead surfaces (such as ceilings). The control system 18 of the preferred self-propelled apparatus 15 is programmable for automatic movement of the coatings removal head assembly 2. The preferred self-propelled apparatus 15 and coatings removal head assembly 2 combine to provide increased coatings removal production rates and improved quality of coatings removal. Coatings removal production rates approaching 1000 square feet per hour are made possible by employing one coatings removal head assembly 2 in accordance with the preferred embodiment of the present invention.

Figure 2:
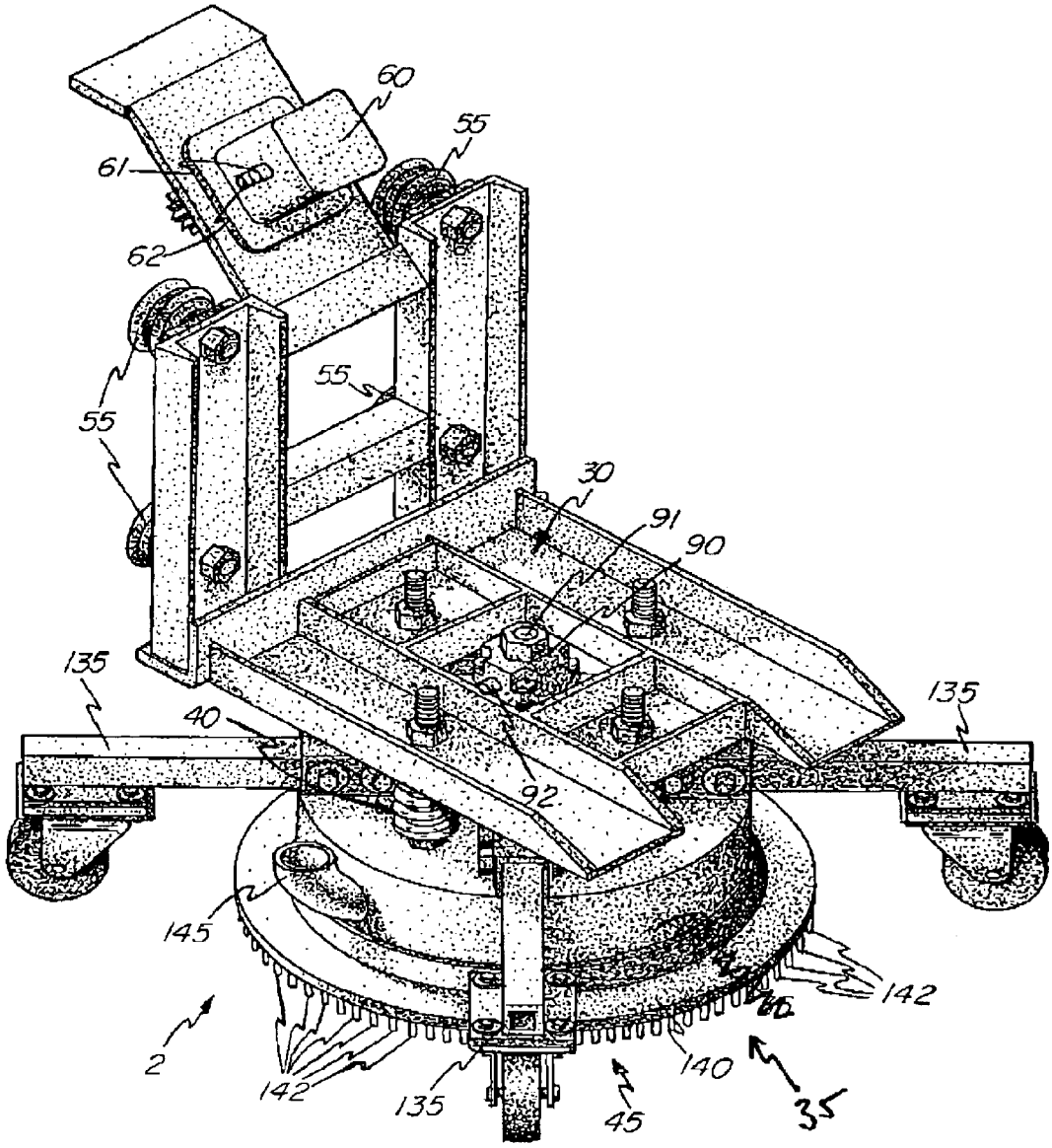
FIG. 2 is a perspective view of the coatings removal head assembly of the present invention.
Figure 3:
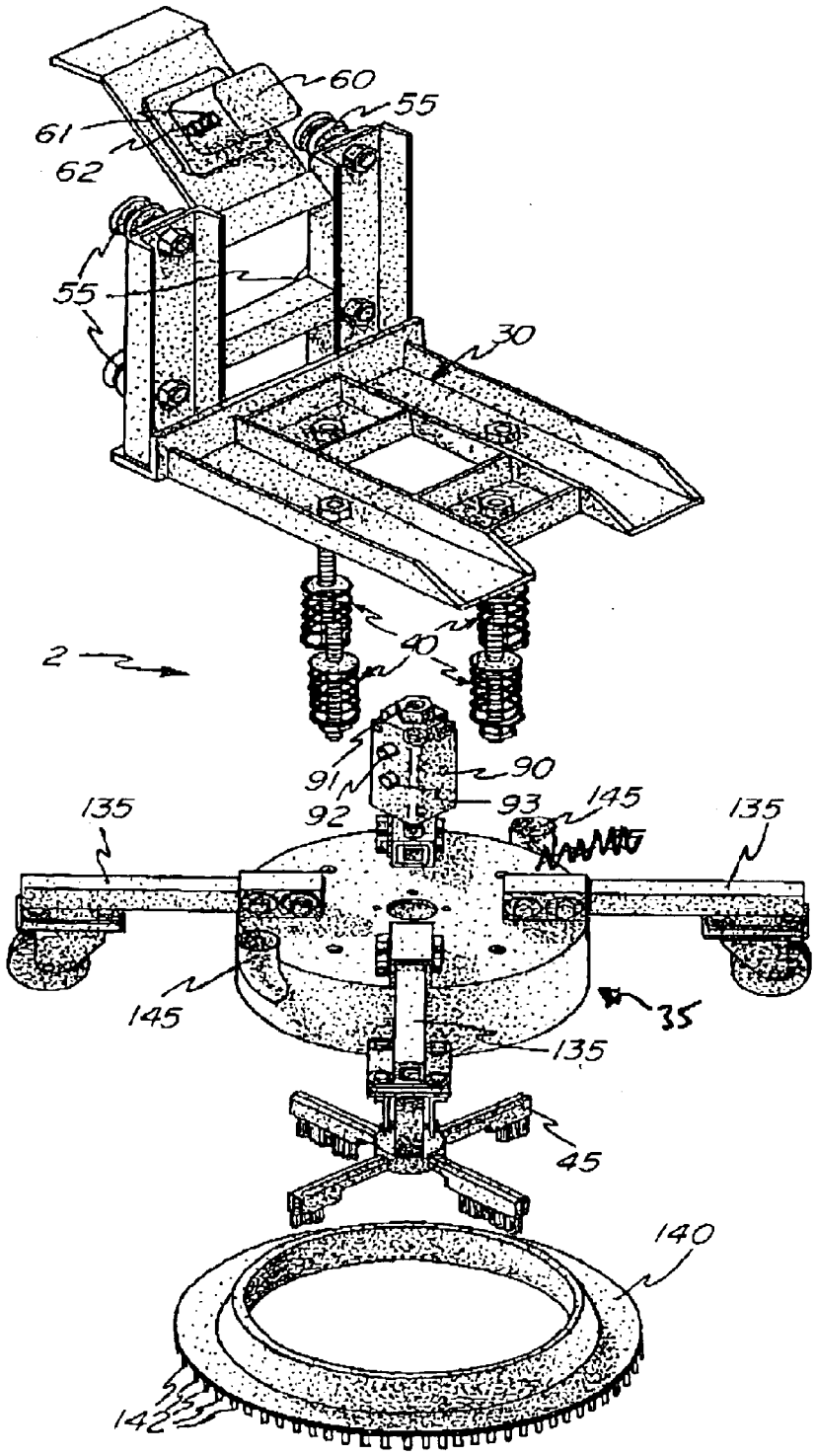
FIG. 3 is an exploded, perspective view of the coatings removal head assembly in accordance with the present invention.

Turning now to FIGS. 2 and 3, the coatings removal head assembly 2 includes a main mounting bracket assembly 30 and 8 housing assembly 35 adjustably attached to the main mounting bracket assembly 30 with interposing spring mounting assembly 38 which includes compression spring assemblies 40. The rotary spray bar assembly 45 (FIG. 3) is disposed within housing assembly 35.

Figure 4:
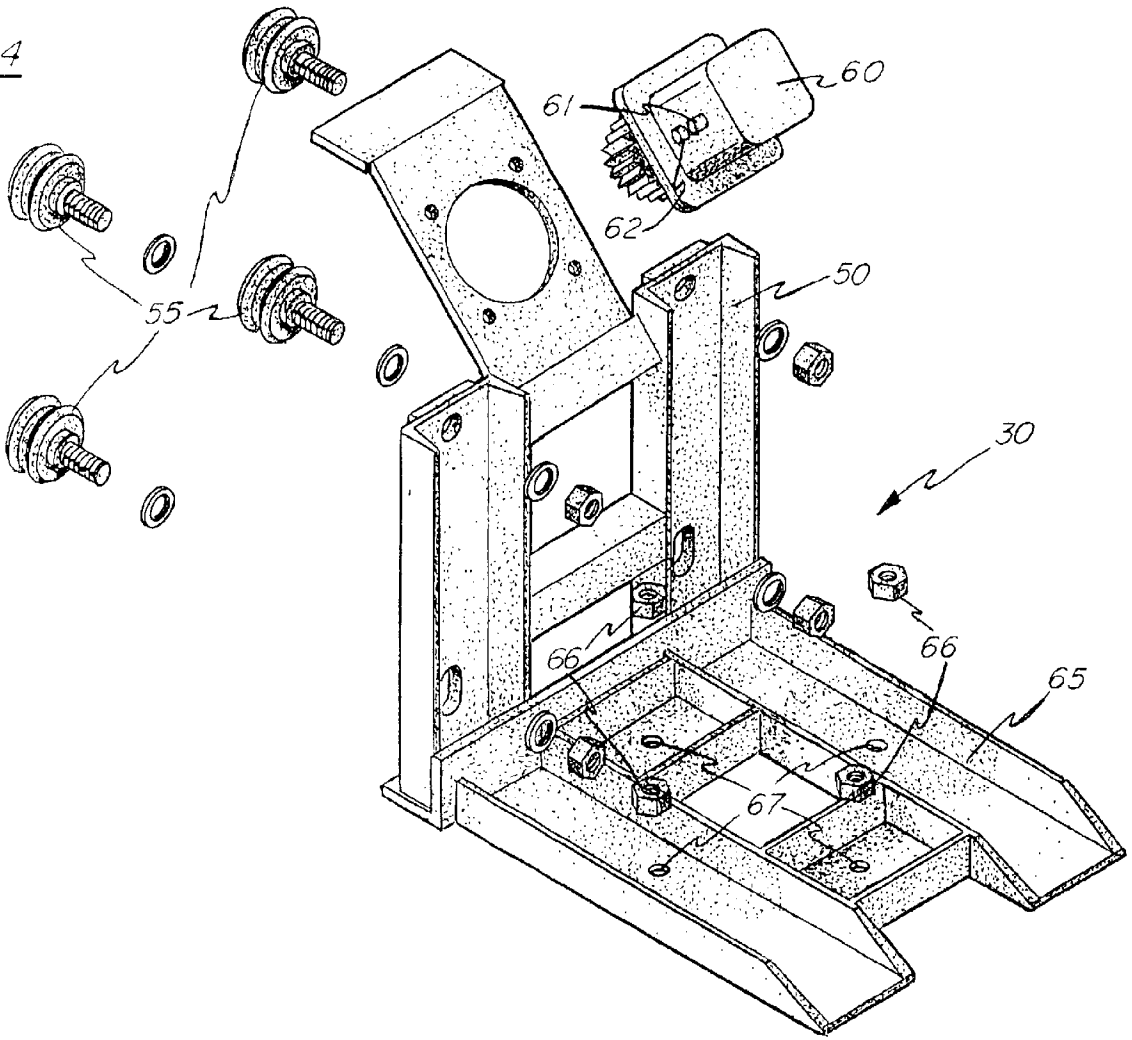
FIG. 4 is an exploded, perspective view of the main bracket assembly for the coatings removal head assembly.

Referring to FIG. 4, the main mounting bracket assembly 30 includes V-wheels 55 rotatably attached to a rear member 50 for mounting the coatings removal head assembly 2 to the mounting rail 5 of the self-propelled apparatus 15. As depicted in FIG. 1, the V-wheels 55 serve to constrain movement of the coatings removal head assembly 2 to linear movement along mounting rail 5. In the preferred embodiment, the V-wheels 55 and mounting rail 5 engage one another with mating "V-shaped" construction. The circumference of the V-wheels 55 can define either a convex or concave V-shape. Positioning drive 60, which is fixed to rear member 50, engages rack gear 10 to move the coatings removal head assembly 2 along the mounting rail 5. The control system 18 of the preferred self-propelled apparatus 15 is programmable to provide automatic movement of the coatings removal head assembly 2 along the mounting rail 5. The preferred positioning drive 60 is a hydraulic motor and is connected to the hydraulic system 17 of the preferred self-propelled apparatus 15. The hydraulic system 17 is connected to positioning drive 60 with hydraulic connections 61,62.

Figure 5:
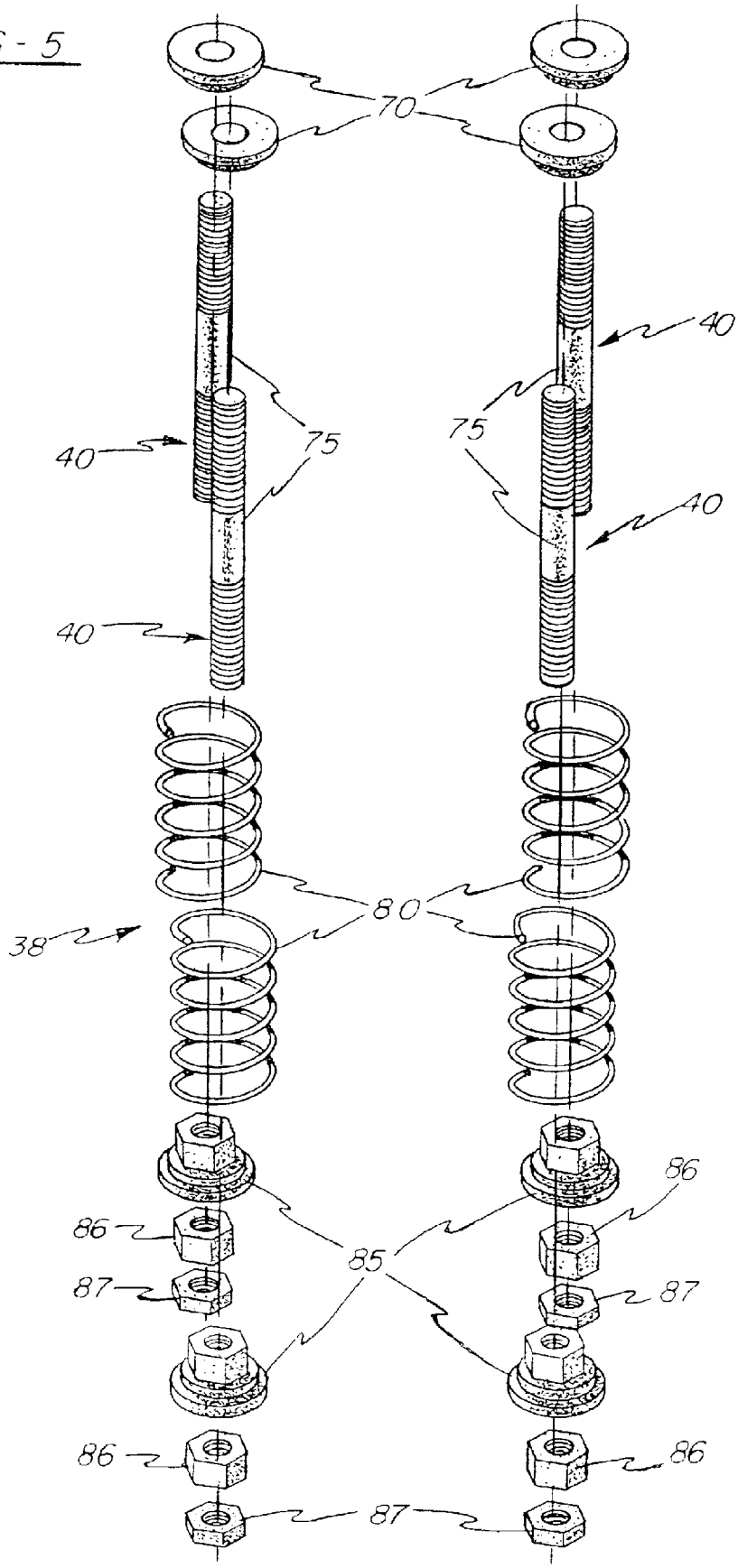
FIG. 5 is an exploded, perspective view of the spring mounting assembly for the coatings removal head assembly.

Referring to FIGS. 2, 3 and 5, the spring mounting assembly 38 is shown interposed between a lower member 65 of main mounting bracket assembly 30 and the housing assembly 35. The preferred embodiment of the coatings removal head assembly 2 incorporates four individual springs 80, with studs 75, upper spring brackets 70, lower spring brackets 85, adjusting nuts 86 and lock nuts 87. In operation, the spring mounting assembly 40 is adjusted in concert with the positioning arm 16 to provide improved automatic nozzle stand-off distance control. Preferably, depending on surface irregularities, the springs 80 are compressed to substantially mid-range such that no movement of the positioning arm 16 is required to maintain the desired nozzle stand-off distance. Compression or expansion of the springs 80 from the mid-range compressed position provides profiled movement of the coatings removal head assembly 2 along the surface to be cleaned. The preferable nozzle stand-off distance is between 1.0 inch and 1.25 inches when utilized with the preferred rotary spray bar assembly 45 and system fluid supply 20 pressure as described below. Most preferably, the nozzle stand-off distance is 1.125 inches. The actual range of automatic adjustment of spring mounting assembly 38 is obtained by selecting the desired length springs 80 and associated studs 75. The housing assembly 35 can be mounted to the main mounting bracket 30 utilizing more or less compression spring assemblies 40 than are shown in the accompanying figures. However, four compression spring assemblies 40 are preferred equally spaced around housing assembly 35 and centered between caster wheel assemblies 135 (the caster wheel assemblies 135 are described below).

The spring mounting assembly 38 includes individual compression spring assemblies 40. Each compression spring assembly 40 comprises a stud 75. One end of the stud 75 has a lower spring bracket 85 with the stud 75 threadingly engaged through the lower spring bracket 85 such that part of the threaded portion of the stud 75 protrudes from the lower for spring bracket 85. The part of the threaded portion of the stud 75 which protrudes from the lower spring bracket 85 is inserted into a corresponding housing hole 131 of the housing cover 130 such that the protruding threaded portion of stud 75 extends into the interior housing assembly 35. An adjusting nut 86 is then threaded onto the threaded portion of stud 75 protruding into housing assembly 35. The low spring bracket 85 and adjusting nut 86 cooperate to provide adjustment of the length of stud 75 which extends interiorly and exteriorly of housing assembly 35 and serves, in part, to adjust the compression of the associated spring 80. A lock nut 87 Is threaded onto stud 75, on the portion of the stud 75 extending to the interior of the housing assembly 35, to secure the adjusting nut 86 and lower spring bracket 85 in the desired location. A spring 80 is placed coaxially with stud 75 such that the spring 80 is on the exterior of housing assembly 35 and with the lower spring bracket 85 located between the spring 80 and the housing cover 130. An upper spring bracket 70, which is not threaded and has a bore diameter slightly larger than the outside diameter of the stud 75, is slid over the stud 75 such that spring 80 is between the upper spring bracket 70 and lower spring bracket 85 and all three are coaxially disposed with stud 75. An end of stud 75 is left extending beyond upper spring bracket 70 and is inserted into main mounting bracket hole 67, which is not threaded and has a bore diameter slightly larger then the outside diameter of the stud 75, such that a part of stud 75 extends beyond main mounting bracket 30. A support nut 66 is threaded onto the portion of the stud 75 extending beyond the main mounting bracket 30. The support nut 66 serves to adjust the maximum distance which the housing assembly 35 can move away from the main mounting bracket 30. As can be appreciated, support nut 66 is adjusted in concert with the lower spring bracket 85 and the adjusting nut 86 to allow for various length springs 80.

As described above, positioning arm 16 is articulated to exert the force required to compress spring 80. Upon exerting a compression force with positioning arm 16, stud 75 will slide further through the hole 66 in the main mounting bracket 30 and compress spring 80. The support nut 66, fixed relative to the position of the stud 75 will move along with the stud 75 away from the main mounting bracket 30 as the spring 80 is compressed. The preferred coatings removal head assembly 2 with caster wheel assemblies 135 will then automatically adjust the nozzle stand-off distance within the range of the associated spring 80. The range automatic adjustment can be selected by utilizing the desired length spring 80 and stud 75.

The combination of articulation of positioning arm 16 and automatic nozzle stand-off distance adjustment facilitated by spring mounting assembly 38 is preferred for contoured surfaces. In such cases, it is preferred that the self-propelled apparatus 15 is equipped with a control system 18 to facilitate automatic articulation of positioning arm 16. However, it will be apparent to one of ordinary skill in the art that the nozzle stand-off distance can be maintained by articulation of positioning arm 16 alone, in which case, the spring mounting assembly 38 is optional.

Figure 6:
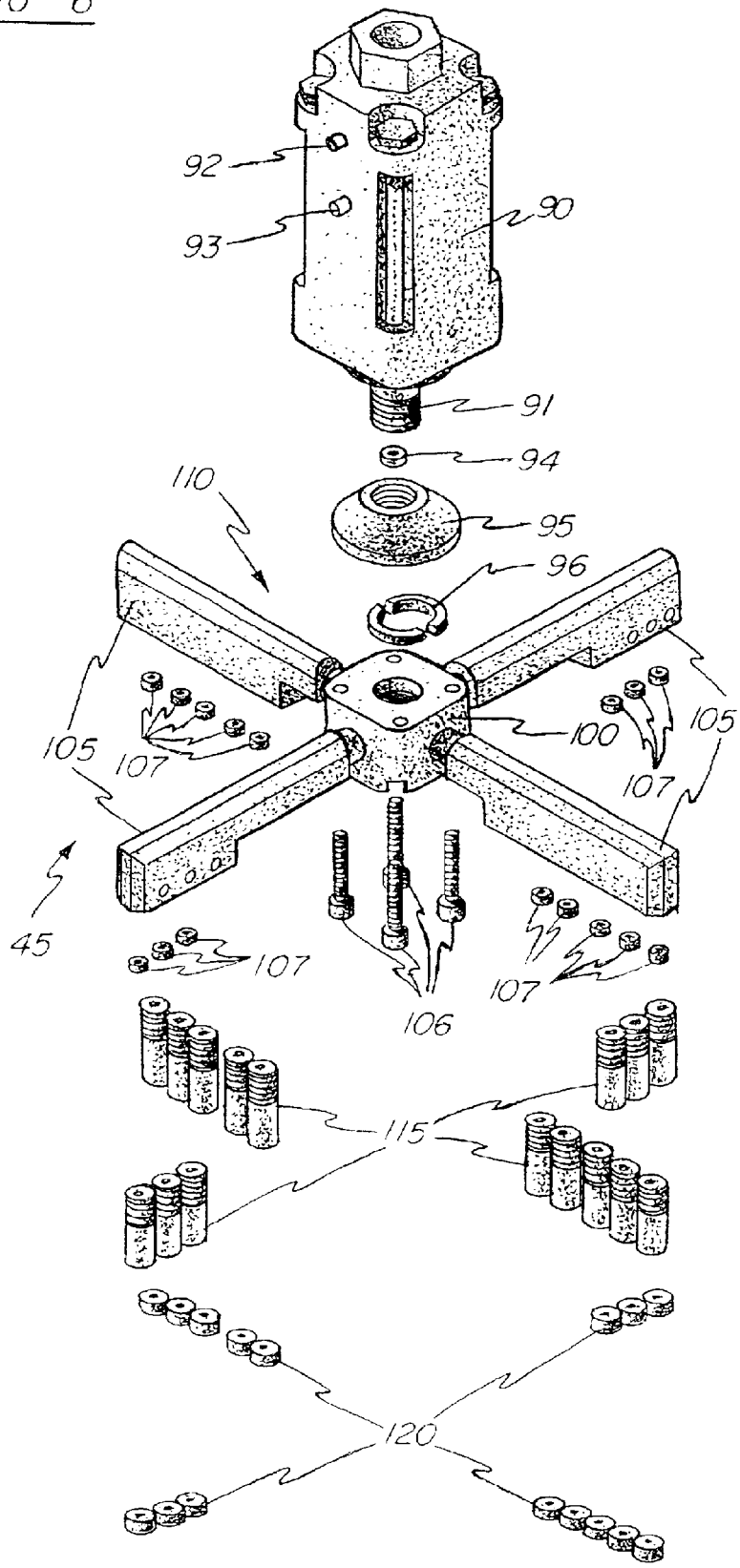
FIG. 6 is an exploded, perspective view of the rotary spray bar assembly for the coatings removal head assembly.

Referring to FIGS. 2, 3 and 6, the rotary spray bar assembly 45 is shown as including a rotary drive 90 mounted external to the housing assembly 35 and includes a hollow drive shaft 91 extending to the interior of housing assembly 35. The hollow drive shaft 91 is rigidly attached to a hub 100 in sealing engagement with the hub 100 and including a sealing flange 94 and rings 95. Rotary drive 90 is fixedly mounted to a housing cover 130 of the housing assembly 35 (see FIG. 7) such that the spray bar assembly 45 is rotatable relative to housing assembly 35.

Four spray bars 105 are connected to hub 100 and are preferably spaced an equal distance around the perimeter of hub 100. In the preferred embodiment, as shown in FIG. 6, two of the spray bars 105 have five nozzles 120 each, with the remaining two spray bars 105 having three nozzles 120 each. Each nozzle 120 is attached to its respective spray bar 105 with and individual connection piece 115. In the preferred embodiment, the nozzles 120 are positioned on the given spray bar 105 such that each nozzle 120 defines a unique, substantially circular, path of rotation during rotation of the hollow drive shaft 91 and hub 100.

The fluid supply 20 is connected to the hollow drive shaft 91 or rotary drive 90. The rotary drive 90 is rigidly attached to the housing cover 130 such that the rotary drive 90 will not move relative to the housing cover. The portion of the hollow drive shaft 91 of the rotary drive 90 which extends into the interior of housing assembly 35 is in threading engagement with ring 95 with seal 94 therebetween. A hollow body hub 100 is fixed to the ring 96 by bolts 106 with packing 96 therebetween. The hollow body hub 100 has a hole which coincides with the end of drive shaft 91 to allow fluid to pass through the hollow drive shaft 91 and into the hub 100. The hub 100 has a threaded hole for each spray bar 105 to threadingly engage therewith. The fluid will pass from within the hollow body hub 100 into a hollow passage though the associated spray bar 115. The fluid will traverse through the hollow interior of the spray bar 155 to the associated connection pieces 115. The connection pieces 105 are received within corresponding threaded holes of the spray bar 105 with nozzle seals 107 therebetween. Fluid passes through the hollow interior of spray bar 105, through the corresponding piece 115, to the associated nozzle 120. The threaded connection pieces 105 with corresponding nozzles 120 cooperate to allow manual adjustment of the nozzle stand-off distance of each nozzle independent of the remaining nozzles 120. The preferred nozzle 120 is a Hammelmann Design "P" nozzle, as manufactured by Hammelmann GmbH, Germany. It should be understood that the present invention is not to be limited to any one nozzle.

The connection piece 115 along with caster wheel assemblies 135 cooperate to provide additional nozzle 120 stand-off distance adjustment. An initial minimum nozzle stand-off distance is set by selecting a desired length connection piece 115 and associated caster wheel assemblies 135.

The preferred rotary drive 90 is capable of rotating the spray bar assembly 45 up to 3600 revolutions per minute. In the preferred embodiment, spray bar assembly 45 is rotated at 1800 revolutions per minute. The preferred rotary drive 90 is a hydraulic motor and is connected to the hydraulic system 17 with hydraulic connections 91,92.

Figure 7:
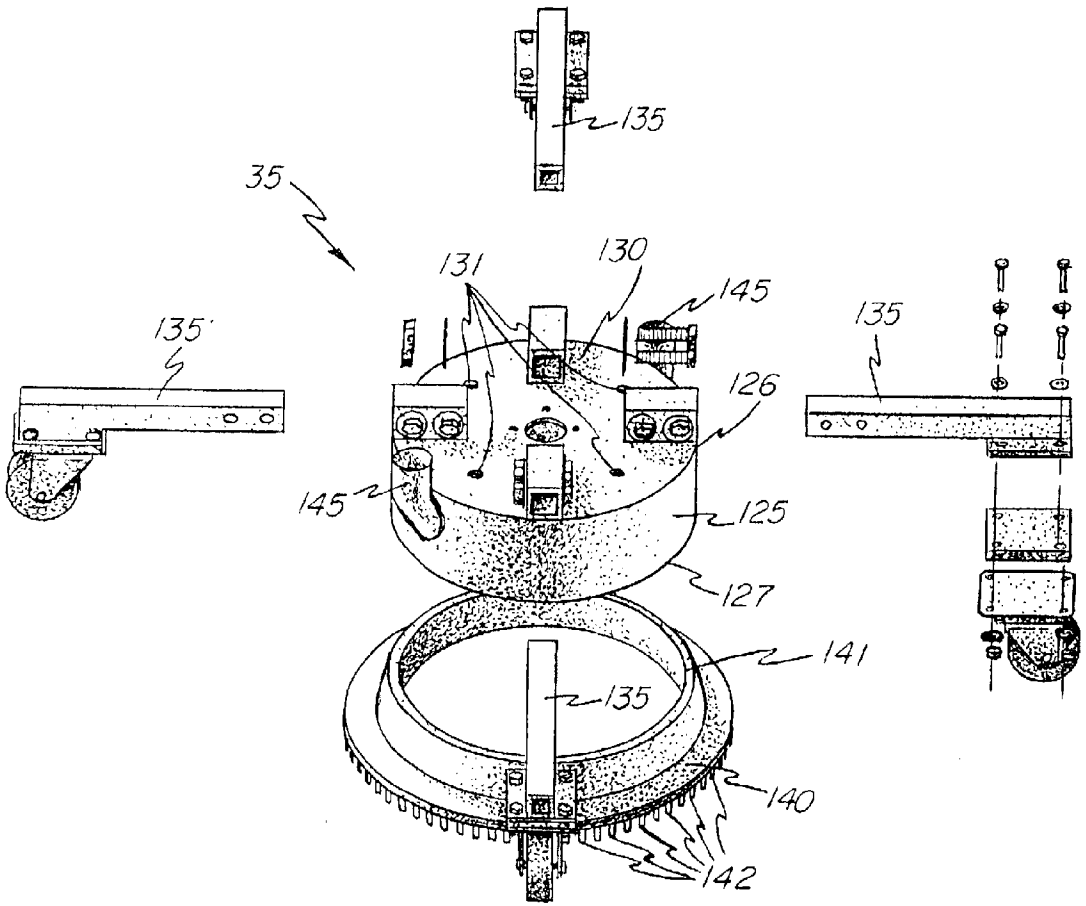
FIG. 7 is an exploded, perspective view of the housing assembly for the coatings removal head assembly.

Referring to FIG. 7, the housing assembly 35 comprises a cylindrical skirt 125 having a first end 126 connected to a housing cover 130. Preferably, skirt 125 is equipped with two exhaust ports 145 spaced 180 degrees apart which are connected to the vacuum containment system 25 as shown in FIG. 1. In a preferred embodiment, skirt 125 has a brush 140 connected thereto on a second end 127 of the skirt 125. The cylindrical skirt 125 with exhaust ports 145 and brush 140 cooperate to provide nearly 100 percent containment of the waste supply fluid and removed coatings. The preferred vacuum containment system 25 has a corresponding flow rate which exceeds the flow rate of the fluid supply 20 along with removed material. The brush 140 includes flexible fingers 142 which protrude toward the surface to be cleaned . The brush 140 with flexible fingers 142 provides space between the skirt 125 and surface to be cleaned such that the fluid and removed material are contained while allowing air flow from the exterior of housing assembly 35 around the flexible fingers 142. The air flow resulting from the specifically placed exhaust ports 145 combined with the airway through the flexible fingers 142 enhances the associated coatings removal head assembly 2 containment. The length and stiffness of the brush 140 and flexible fingers 142 are selected along with caster wheel assemblies 135 to provide a desired airway.

The preferred embodiment of coatings removal head assembly 2 incorporates a cylindrical skirt 125 with a 16 inch diameter. It should be understood that the present invention is not limited to any given skirt 125 diameter, shape or specific number of exhaust ports 145. The preferred brush 140 is a Hammelmann part number 00.00594.0007, as manufactured by Hammelmann Corporation, Dayton, Ohio. It should be understood that the invention is not limited to a specific brush.

The coatings removal head assembly 2, in accordance with the present invention, can be operated without a vacuum containment system 25 connected, should containment not be desired. In such cases, exhaust ports 145 and brush 140 are optional.

Additionally shown in FIG. 7 are caster wheel assemblies 135. The preferred embodiment of coatings removal head assembly 2 incorporates four caster wheel assemblies 135 equally spaced around housing assembly 2 and connected to the cover 130. The caster wheel assemblies 135 provided further control over nozzle 120 stand-off distance. The diameter of the given caster wheel, in cooperation with the connection pieces 115 and nozzles 120 control the minimum stand-off distance for any given configuration. It is preferred that an equal number of springs 80 and caster wheel assemblies 135 are employed, with each spring 80 being disposed substantially centered between adjacent caster wheel assemblies 135.

The coatings removal system 1, as shown in FIG. 1, can be utilized in a number of varying applications. As an example, the coatings removal system 1 can be used to remove a "no-skid" material from the deck of a ship. The self-propelled apparatus 15, with coatings removal head assembly 2 attached thereto, is positioned relative to the ship deck such that the coatings removal head assembly 2 is rearwardly located relative to the desired direction of travel. The positioning arm 16 is articulated such that the coatings removal head assembly 2 will pass substantially parallel to the ship deck as the coatings removal head assembly 2 moves linearly side-to-side along mounting rail 5 and as self-propelled apparatus 15 advances along the desired course. Additionally, the positioning arm 16 is set such that the springs 80 are compressed substantially half way between being fully compressed and fully extended. In this manner, the housing assembly 35 will be free to travel away from, and toward, the ship deck automatically within the range of compression and expansion for the springs 80. The control system 18 of the preferred self-propelled apparatus 15 is programmed to automatically move the coatings removal head assembly 2 from side-to-side along mounting rail 5, defining a single cut. The control system 18 of the preferred self-propelled apparatus 15 is further programmed to advance the self-propelled apparatus 15 in the desired direction such that the coatings removal head assembly 2 will pass over an uncleaned portion of the ship deck in a subsequent movement along mounting rail 5 (i.e., the self-propelled apparatus is advanced equal to the cut width of the coatings removal head assembly 2 minus the desired overlap). The coatings removal head assembly 2 is then moved in the opposite direction along mounting rail 5. The steps of moving the coatings removal head assembly 2 in one direction along mounting rail 5, advancing the self-propelled apparatus 15, moving the coatings removal head assembly 2 in the opposite direction along mounting rail 5 and then advancing the self-propelled apparatus are repeated until the self-propelled vehicle traverses the desired length of the ship deck, defining a single pass. Should the ship deck be wider than the length of mounting rail 5, which is typically the case, the self-propelled apparatus 15 and coatings removal head assembly 2 is repositioned and the process as outlined in the preceding example is repeated, defining a coatings removal process.

It will be apparent that multiple coatings head removal assemblies 2 can be mounted to the same self-propelled apparatus 15 or multiple self-propelled apparatuses 15 can be employed to clean a larger area in less time. Depending on the operating environment, a single operator can operate more than one coatings removal system 1 at a given time.

It is to be understood that the numerous alternatives and equivalents will be apparent to those of ordinary skill in the art, given the teachings herein, such that the present invention is not to be limited by the foregoing description but only by the appended claims.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A coatings removal head assembly, comprising:

a support member;

a housing assembly supported by said support member;

a biasing mechanism interposed between and directly connecting said housing assembly to said support member to bias said housing assembly away from said support member and being operable to permit movement of sold housing assembly toward and away from said support member; and a rotary processing device supported within said housing assembly and being operable to rotate within said housing assembly and move with said housing assembly toward and away from said support member to process a surface covered by said housing assembly.

2. The coatings removal head assembly of claim 1 wherein said biasing mechanism comprises a spring assembly.

3. The coatings removal head assembly of claim 1 further comprising a plurality of supports operatively connected to said housing assembly to support said housing assembly relative to the surface being processed.

4. The coatings removal head assembly of claim 3 wherein each of said supports comprises a caster.

5. The coatings removal head assembly of claim 1 further comprising a drive mechanism operatively connected to said rotary processing device and being operable to rotate said rotary processing device within said housing assembly.

6. The coatings removal head assembly of claim 5 wherein said drive mechanism comprises a motor.

7. The coatings removal head assembly of claim 1 wherein said rotary process device comprises a rotary spray bar.

8. The coatings removal head assembly of claim 7 further comprising a plurality of spray nozzles mounted in fluid communication with said rotary spray bar.

9. The coatings removal head assembly of claim 1 further comprising a flexible barrier supported by said housing assembly and being configured to engage the surface being processed.

10. A coatings removal head assembly, comprising:

a housing assembly mounted to a main mounting bracket assembly with an interposing spring assembly and a rotary spray bar assembly disposed within said housing assembly;

said housing assembly including a cylindrical housing with first and second ends defining a central axis therebetween, a housing cover connected to said first end of said cylindrical housing with an attachment means for attachment to said spring assembly, four casters connected to said housing assembly and a brush connected to said second end of said cylindrical housing;

said main mounting bracket assembly including a bracket with a first attachment means for attachment to said spring assembly and a second attachment means for movable attachment of said costing removal head assembly to portable equipment, said second attachment means includes a hydraulic motor with gear drive and four V-wheels;

said spring assembly including four springs each with and adjustable mounting means for connection at a first end to said main mounting bracket assembly and at a second end to said housing assembly; and said rotary spray bar assembly including a hydraulic motor mounted to said housing assembly and sealingly and rotatably connected to a hub, said hub being disposed within said housing assembly; first, second, third and fourth spray bars; said first and third spray bare having three spray nozzles each, said second and fourth spray bars having five spray nozzles each; each of sixteen spray nozzles being connected to the given spray bar such that each nozzle traverses an individual substantially circular path when said rotary spray bar rotates about said central axis.

11. A coatings removal system, comprising:

a self-propelled apparatus; and a coatings removal head assembly supported by said self-propelled apparatus, wherein said coatings removal head assembly comprises:

a support member;

a housing assembly supported by said support member;

a biasing mechanism interposed between and directly connecting said housing assembly to said support member to bias said housing assembly away from said support member and being operable to permit movement of said housing assembly toward and away from said support member; and a rotary processing device supported within said housing assembly and being operable to rotate within said housing assembly and move with said housing assembly toward and away from said support member to process a surface covered by said housing assembly.

12. The coatings removal system of claim 11 wherein said biasing mechanism comprises a spring assembly.

13. The coatings removal system of claim 11 further comprising a plurality of supports operatively connected to said housing assembly to support said housing assembly relative to the surface being processed.

14. The coatings removal system of claim 13 wherein each of said supports comprises a caster.

15. The coatings removal system of claim 11 further comprising a drive mechanism operatively connected to said rotary processing device and being operable to rotate said rotary processing device within said housing assembly.

16. The coatings removal system of claim 15 wherein said drive mechanism comprises a motor.

17. The coatings removal system of claim 11 wherein said rotary process device comprises a rotary spray bar.

18. The coatings removal system of claim 17 further comprising a plurality of spray nozzles mounted in fluid communication with said rotary spray bar.

19. The coatings removal system of claim 11 further comprising a flexible barrier supported by said housing assembly and being configured to engage the surface being processed.

20. The coatings removal system of claim 11 further comprising a fluid supply system supported in fluid communication with said housing assembly and being operable to provide a flow of processing fluid within said housing assembly.

21. The coatings removal system of claim 20 further comprising a vacuum containment system supported in fluid communication with said housing assembly and being operable to remove and contain processing fluid and surface debris from said housing assembly.

22. The coatings removal system of claim 11 further comprising a positioning arm operatively connecting said coatings removal head assembly to said self-propelled apparatus and being operable to move said coatings removal head assembly in a plurality of orientations relative to said self-propelled apparatus.

23. The coatings removal system of claim 11 further comprising a mounting mechanism operatively connected to said support member and said self-propelled apparatus, said mounting mechanism being operable to guide said coatings removal head assembly along a linear path defined by said mounting mechanism.

24. The coatings removal system of claim 22 further comprising a mounting mechanism operatively connected to said support member and said positioning arm, said mounting mechanism being operable to guide said coatings removal head assembly along a linear path defined by said mounting mechanism.

25. The coatings removal system of claim 23 further comprising a drive mechanism operatively connected to said mounting mechanism and said support member, said drive mechanism being operable to move said coatings removal head assembly along the linear path defined by said mounting mechanism.

26. The coatings removal system of claim 11 further comprising a control system capable of automatically positioning said coatings removal head assembly.

27. The coatings removal system of claim 11 further comprising a control system capable of automatically positioning said self-propelled apparatus.

28. A coatings removal system, comprising:

a self-propelled apparatus; and a coatings removal head assembly supported by said self-propelled apparatus, wherein said coatings removal head assembly comprises:

a support member;

a housing assembly supported by said support member; and a rotary processing device supported within said housing assembly and being operable to rotate within said housing assembly to process a surface covered by said housing assembly; and an elongated mounting mechanism operatively connected to said support member and said self-propelled apparatus, said mounting mechanism defining a linear path and being operable to guide said coatings removal head assembly along the linear path defined by said mounting mechanism.

29. The coatings removal system of claim 28 further comprising a biasing mechanism operatively connecting said housing assembly to said support member to bias said housing assembly away from said support member and being operable to permit movement of said housing assembly toward and away from said support member.

30. The coatings removal system of claim 29 wherein said biasing mechanism comprises a spring assembly.

31. The coatings removal system of claim 28 further comprising a plurality of supports operatively connected to said housing assembly to support said housing assembly relative to the surface being processed.

32. The coatings removal system of claim 31 wherein each of said supports comprises a caster.

33. The coatings removal system of claim 28 further comprising a drive mechanism operatively connected to said rotary processing device and being operable to rotate said rotary processing device within said housing assembly.

34. The coatings removal system of claim 33 wherein said drive mechanism comprises a motor.

35. The coatings removal system of claim 28 wherein said rotary process device comprises a rotary spray bar.

36. The coatings removal system of claim 35 further comprising a plurality of spray nozzles mounted in fluid communication with said rotary spray bar.

37. The coatings removal system of claim 28 further comprising a flexible barrier supported by said housing assembly and being configured to engage the surface being processed.

38. The coatings removal system of claim 28 further comprising a fluid supply system supported in fluid communication with said housing assembly and being operable to provide a flow of processing fluid within said housing assembly.

39. The coatings removal system of claim 38 further comprising a vacuum containment system supported in fluid communication with said housing assembly and being operable to remove and contain processing fluid and surface debris from said housing assembly.

40. The coatings removal system of claim 28 further comprising a positioning arm operatively connecting said coatings removal head assembly to said self-propelled apparatus and being operable to move said coatings removal head assembly in a plurality of orientations relative to said self-propelled apparatus.

41. The coatings removal system of claim 28 further comprising a drive mechanism operatively connected to said mounting mechanism and said support member, said drive mechanism being operable to move said coatings removal head assembly along the linear path defined by said mounting mechanism.

42. The coatings removal system of claim 28 further comprising a control system capable of automatically positioning said coatings removal head assembly.

43. The coatings removal system of claim 28 further comprising a control system capable of automatically positioning said self-propelled apparatus.

* * * * *